United States Patent [19]

Grellmann

[11] Patent Number: 4,789,791

[45] Date of Patent: Dec. 6, 1988

[54] ROTARY DRIVE MECHANISM

[75] Inventor: H. Erwin Grellmann, Beaverton, Oreg.

[73] Assignee: Tektronix, Inc., Beaverton, Oreg.

[21] Appl. No.: 911,701

[22] Filed: Sep. 26, 1986

[51] Int. Cl.[4] ..... H01H 35/00; H01H 3/00; H01H 21/04

[52] U.S. Cl. ..... 307/119; 307/122; 307/140; 200/153 T; 200/153 SC; 200/67 PK; 200/67 B

[58] Field of Search ..... 307/119, 122, 139, 140, 307/132 R, 141; 200/67 B, 153 T, 153 SC, 67 PK, 33 R

[56] References Cited

U.S. PATENT DOCUMENTS 2,753,412 7/1956 Link ..... 200/67 B 4,520,331 5/1985 Steidel ..... 335/125

*Primary Examiner*—William M. Shoop, Jr.

*Assistant Examiner*—Sharon D. Logan

*Attorney, Agent, or Firm*—Francis I. Gray

[57] ABSTRACT

A rotary drive mechanism has a yoke mounted on a motor shaft which engages a crank connected to a device to be rotated, such as the rotary portion of a microwave switch. When the gear motor is activated, the yoke causes the crank to move from a first position to a position past top dead center. A spring connected to the crank causes the crank to snap from the position past top dead center to a second position. A microswitch at the second position provides a signal to brake the motor when the crank reaches the second position. The yoke is configured like a V with the attachment point to the motor being the base of the V. A post from the crank is contained within the area defined by the legs of the V at a point where the shaft will not contact the opposite leg when the crank passes top dead center and is snapped to the second position.

5 Claims, 2 Drawing Sheets

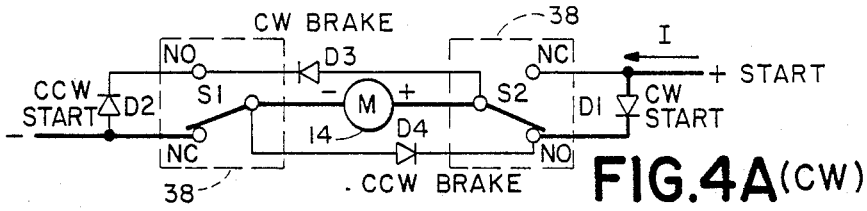
FIG.4A(CW)
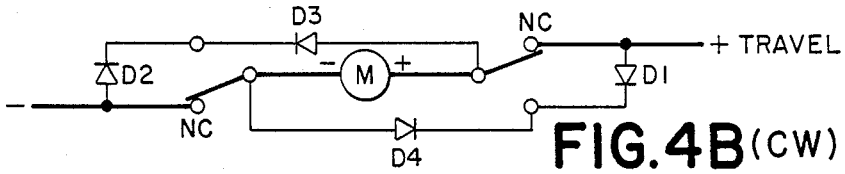
FIG.4B(CW)
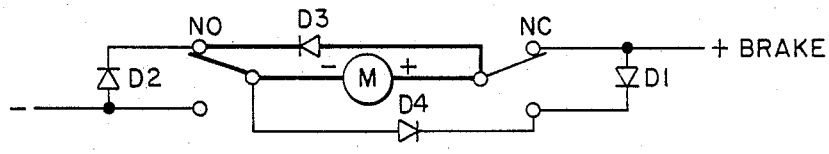
FIG. 4C(CW)
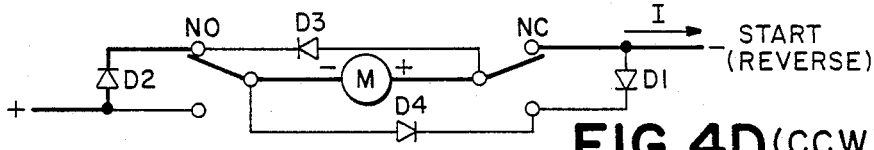
FIG.4D(CCW)
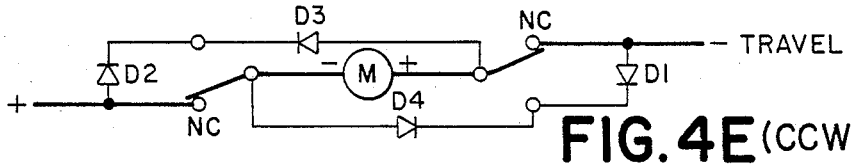
FIG.4E(CCW)
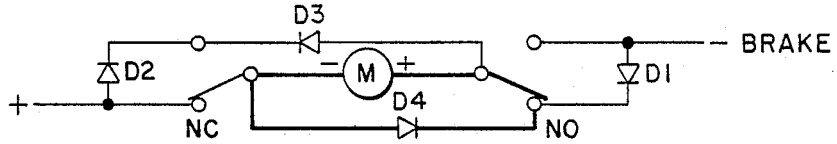
FIG.4F (CCW)

ROTARY DRIVE MECHANISM

BACKGROUND OF THE INVENTION

The present invention relates to switch mechanisms, and more particularly to a rotary drive mechanism for a microwave switch.

In the past switches that required rotation of ninety degrees or more were difficult and bulky to build without going to exotic mechanisms or motor control and feedback. For switches using a slider crank the difficulty is overcoming top dead center (TDC) in a power stroke, a phenomenon that occurs with rotating linkages.

What is desired is a compact, bi-stable (latching) mechanism that can move the rotor on a microwave switch ninety degrees or more to precisely placed stops with minimum power consumption.

SUMMARY OF THE INVENTION

Accordingly the present invention provides a rotary drive mechanism for a microwave switch which is powered by a direct current motor, and which has power requirements low enough so that it can be driven directly by transistor-transistor logic (TTL). A yoke is driven by the motor and engages a crank post. The crank is driven over top dead center by the yoke, and then snapped against a stop by a spring. Upon hitting the stop a microswitch is tripped, applying braking to the motor. Current applied in the opposite direction causes the motor to rotate in the opposite direction.

The objects, advantages and novel features of the present invention will be apparent from the following detailed description when read in conjunction with the appended claims and attached drawing

BRIEF DESCRIPTION OF THE DRAWING

FIGS. 4A–4B are schematic views illustrating the operation of the rotary drive mechanism according to the present invention.

DESCRIPTION OF THE PREFERRED EMBODIMENTS

Figure 1:
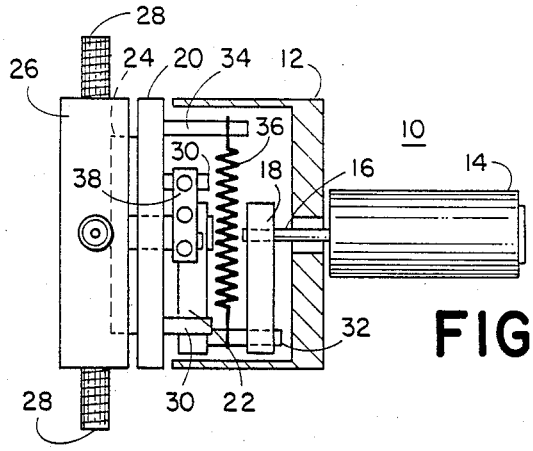
FIG. 1 is a partial cutaway view of a switch using a rotary drive mechanism according to the present invention.
Figure 3:
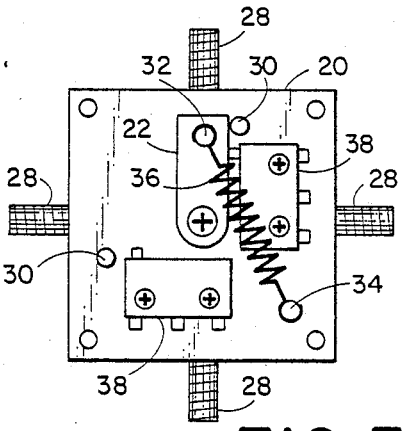
FIG. 3 is a top plan view of the switch housing for the switch FIG. 1.
Figure 2:
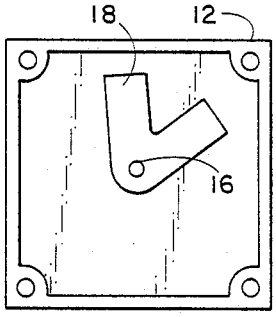
FIG. 2 is a bottom plan view of the motor housing for the switch of FIG. 1.

Referring now to FIGS. 1–3 a switch device 10 using the rotary drive mechanism of the present invention is shown. A motor housing 12 has a gear motor 14 mounted thereon with a shaft 16 protruding into the interior of the housing. Attached to the shaft 16 is a yoke 18 in the shape of a V, the attachment point of the shaft being the base of the V. A switch cover 20 has a crank 22 rotatively mounted thereon, which crank is connected to a switch rotor 24 within a switch 26. Movement of the crank 22 causes corresponding movement of the rotor 24, switching signals between ports 28 of the switch 26. Also fixedly mounted on the switch cover 20 are a pair of limit stops 30 situated approximately ninety degrees apart with reference to the pivot point of the crank 22. A crank post 32, fixedly mounted on the crank 22, engages the yoke 18 between the legs of the V so that, as the yoke is rotated by the motor shaft 16, the crank is also caused to rotate. A spring post 34 is fixedly mounted on the switch cover 20 on the opposite side from the top dead center point of the crank 22 and in line with the pivot point of the crank. A spring 36 is extended between the spring post 34 and the crank post 32 to pull the crank 22 against the nearest stop 30. Finally a pair of microswitches 38 are fixedly mounted on the switch cover 20 so that when the crank 22 reaches one of the stops 30 the microswitch is activated to change position from normally closed to normally open.

In operation, as shown in FIGS. 4A–4F, when a dc voltage is applied to the gear motor 14, the current flows through a starting diode D1, through the normally open contact of the activated microswitch 38, through the motor, and through the normally closed contact of the inactivated microswitch (FIG. 4A). As the motor 14 starts to move, the yoke 18 engages the crank post 32, causing the crank 22 to move away from the stop 30. As the crank 22 moves away from the stop 30, the activated microswitch 38 becomes inactivated and the current now flows through both normally closed contacts of the microswitches (FIG. 4B). As the movement of the yoke 18 causes the crank 22 to move past top dead center, the spring 36 causes the crank to be snapped against the opposite stop 30 since there is enough play between the legs of the V of the yoke. The opposite microswitch 38 is activated, its contact moving to normally open, and current flows in a loop through a braking diode D3 and the gear motor 14 to brake the motor before the yoke 18 again comes into contact with the crank post 32. (FIG. 4C). Reversing the polarity of the dc voltage causes the motor 14 to reverse, moving the crank 22 in a like manner as described above back to the original stop 30 (FIGS. 4D–4F). Since the switch rotor 24 is attached to the crank 22, switching action occurs within the switch 26.

Thus the present invention provides a compact, bistable mechanism for switching between two positions by positively driving a crank over the top dead center, and stopping the motor before the drive mechanism reaches the stop point.

What is claimed is:

1. A rotary drive mechanism comprising:

a crank connected to a device to be rotated;

means for positively engaging the crank to start movement of the crank;

means for driving the engaging means such that the crank moves from a first position to a position past top dead center; and means for moving the crank from the position past top dead center to a second position independent of the driving means.

2. A rotary drive mechanism as recited in claim 1 further comprising means for braking the driving means when the crank reaches the second position.

3. A rotary drive mechanism as recited in claim 2 wherein the braking means comprises:

means for detecting when the crank reaches the second position; and means responsive to the detecting means for applying a braking force to the driving means.

4. A rotary drive mechanism as recited in claim 1 wherein the engaging means comprises:

a crank post fixedly mounted on the crank; and a yoke mounted on the driving means configured so as to engage the crank post and cause the crank to move in response to the driving means.

5. A rotary drive mechanism as recited in claim 4 wherein the moving means comprises a spring connected between a spring post and the crank post such that, when the crank reaches the position past top dead center, the spring urges the crank to the second position, the yoke being configured to allow such movement independent of the driving means.

* * * * *